US005186129A

United States Patent [19]

Magnan et al.

[11] Patent Number: 5,186,129

[45] Date of Patent: Feb. 16, 1993

[54] INTERMITTENT OILING SYSTEM FOR AN INTERNAL COMBUSTION ENGINE CAMSHAFT AND VALVE TRAIN

[75] Inventors: Michael B. Magnan, Dearborn; Charles A. Reichling, Grosse Pointe Woods; Robert H. Wells, Dearborn Heights, all of Mich.

[73] Assignee: Ford Motor Company, Dearborn, Mich.

[21] Appl. No.: 859,785

[22] Filed: Mar. 30, 1992

[51] Int. Cl.[5] ..... F01M 1/06

[52] U.S. Cl. ..... 123/90.34; 123/90.33

[58] Field of Search ..... 123/90.33, 90.34, 90.35, 123/196 M

[56] References Cited

U.S. PATENT DOCUMENTS

| | | | |
|---|---|---|---|
| 1,175,720 | 3/1916 | Delaunay-Belleville | 123/90.34 |
| 1,265,145 | 5/1918 | Vincent | 123/90.34 |
| 1,469,063 | 9/1923 | Wills | 123/90.34 |
| 1,497,503 | 6/1924 | Greuter | 123/90.34 |
| 1,590,073 | 6/1926 | Birkigt | 123/90.34 |
| 1,684,955 | 9/1928 | Goodwin . | |
| 3,033,314 | 5/1962 | Wetterhahan . | |
| 3,116,647 | 1/1964 | Leake . | |
| 3,531,234 | 9/1970 | Ravenel . | |
| 3,628,513 | 12/1971 | Grousseau | 123/90.34 |
| 4,392,463 | 7/1983 | Yasuhara | 123/196 M |
| 4,441,464 | 4/1984 | Nakamura | 123/196 M |
| 4,528,673 | 3/1981 | Stoody, Jr. et al. | 123/90.34 |
| 4,615,310 | 10/1986 | Umeha et al. | 123/90.34 |
| 4,644,912 | 2/1987 | Umeha et al. | 123/90.34 |
| 4,711,203 | 12/1987 | Seidl | 123/90.34 |
| 4,729,349 | 3/1988 | Sonoda et al. | 123/90.34 |
| 4,777,842 | 10/1988 | Yamada | 123/90.34 |
| 4,876,916 | 10/1989 | Maier | 123/90.34 |
| 4,942,855 | 7/1990 | Muto . | |
| 4,949,683 | 8/1990 | Swars | 123/90.34 |
| 4,957,079 | 9/1990 | Nakatani | 123/90.34 |
| 4,974,561 | 12/1990 | Murasaki et al. | 123/90.34 |

FOREIGN PATENT DOCUMENTS

| | | | |
|---|---|---|---|
| 55-37552 | 3/1980 | Japan | 123/90.34 |
| 60-88809 | 5/1985 | Japan | 123/90.34 |

*Primary Examiner*—E. Rollins Cross
*Assistant Examiner*—Thomas N. Moulis
*Attorney, Agent, or Firm*—Jerome R. Drouillard; Roger L. May

[57] ABSTRACT

An oiling system for an engine valve train includes a camshaft having an interior divided into separate internal lubrication passages, with the passages being sequentially supplied with lubricating oil so that the lobes of the cam are lubricated sequentially.

11 Claims, 2 Drawing Sheets

INTERMITTENT OILING SYSTEM FOR AN INTERNAL COMBUSTION ENGINE CAMSHAFT AND VALVE TRAIN

BACKGROUND OF THE INVENTION

1. Field of the Invention

The present invention relates to a system for minimizing the lubrication pumping requirements of an engine equipped with a camshaft-operated valve train.

2. Disclosure Information

Oiling systems for the valve machinery of conventional internal combustion engines have been the topic of numerous inventions attempting to deal with problems arising from the need to provide adequate lubrication for those portions of the valve train subjected to high contact pressure. Such areas include the valve stem tip to rocker arm interface, and particularly, the camshaft lobe to lifter interface. Conventionally, a large volume of oil has been circulated to the camshaft and its associated machinery. It is one object of the present invention to reduce this volume of oil without sacrificing adequate camshaft and lifter lubrication.

U.S. Pat. No. 1,684,955 to Goodwin, U.S. Pat. No. 4,644,912 to Umeha et al. and U.S. Pat. No. 4,949,683 to Swars all disclose systems in which oil is conducted through hollow camshafts. Although the system shown in the '955 patent allows timed introduction of the oil to the vicinity of the valve lifter, it suffers from the deficiency that its concentric camshaft arrangement would be expected to exhibit a high frictional drive requirement. As a result, the parasitic losses associated with such a system would be unacceptable.

Camshafts are typically provided with oil introduced through the cam journals in the manner shown in U.S. Pat. No. 4,392,463 to Yasuhara at FIG. 3. Thus, a bearing surrounding the camshaft journal is provided with a slot which feeds oil into the interior of the camshaft. Unfortunately, if nothing more is done to control the consumption of oil by the camshaft, the power requirement associated with operating the engine's oil pump so as to have a sufficient volume of oil available to the camshaft, may be excessive. It is an object of the present invention to provide an intermittent oiling system for a camshaft and its associated valve train which minimizes the amount of oil pumped through the camshaft, thereby minimizing the capacity of the engine's oil pump required to handle the camshaft's lubrication requirements.

U.S. Pat. No. 4,258,673 to Stoody, Jr. et al., U.S. Pat. No. 4,711,203 to Seidl and U.S. Pat. No. 4,974,561 to Murasaki et al. disclose systems in which oil is provided via a camshaft support having a port formed therein for squirting oil upon part of the engine's valve train, other than the camshaft.

U.S. Pat. No. 3,116,647 to Leake and U.S. Pat. No. 3,628,513 to Grosseau disclose rocker arm arrangements allowing timed squirting of oil based upon the rotational position of the rocker arm.

It is an object of the present invention, as noted above, to produce an engine having minimal oil pump requirements associated with the valve train of the engine.

It is an advantage of a system according to the present invention that, due to the fact that less oil will be conducted into the upper part of the engine, the drain-back holes required to allow the oil to fall back down to the crankcase may be minimized.

It is another advantage of the present invention that because less oil will be required to be brought to the top of the engine with this invention, less oil/air aerosols will be formed, thereby reducing the separation requirements which otherwise would be imposed upon the engine's positive crankcase ventilation system. Mitigation of formation of oil/air aerosols is beneficial because movement of lubricating oil into the engine exhaust may have adverse effects upon the life of catalytic exhaust emission control devices.

SUMMARY OF THE INVENTION

An oiling system for an engine valve train includes a plurality of camshaft support assemblies, with each of the assemblies having a camshaft supply passage serviced with lubricating oil from an oil pump or other supply of lubricating oil under pressure. The oiling system further includes a camshaft having a plurality of actuating lobes and a plurality of bearing journals. The camshaft is journaled for rotation within the camshaft support assemblies such that one journal is mounted to each support assembly. The camshaft has a plurality of separate internal lubrication passages, with each passage extending from one of the journals to the surface of at least one of the lobes, such that lubricating oil is conducted from the camshaft supply passages in the support assemblies to the lobes. Each internal lubrication passage within the camshaft is fed by an oil induction port formed in a camshaft journal and cooperating with a camshaft supply passage such that oil is admitted into only one of the internal lubrication passages at any particular rotational position of the camshaft. The lubricant induction Ports are dispersed about the rotational axis of the camshaft such that each of the ports is provided with lubricant for about 45° of camshaft rotation. A camshaft support assembly according to the present invention may be located in the cylinder block of the engine or the cylinder head.

According to another aspect of the present invention, a method for providing lubrication to the valve train of an engine having a camshaft journaled within a plurality of camshaft bearing supports comprises the steps of: supplying oil under pressure to camshaft supply passages formed in the bearing supports and allowing oil to pass discontinuously from the supply passages to a plurality of chambers formed in the interior of the camshaft by means of passages in the camshaft's journals and then out of the chambers through exit ports formed in the lobes of the camshaft. The method further includes timing the flow of oil into the interior chambers of the camshaft such that not all of the chambers are simultaneously supplied with oil under pressure.

DETAILED DESCRIPTION OF THE PREFERRED EMBODIMENTS

Figure 1:
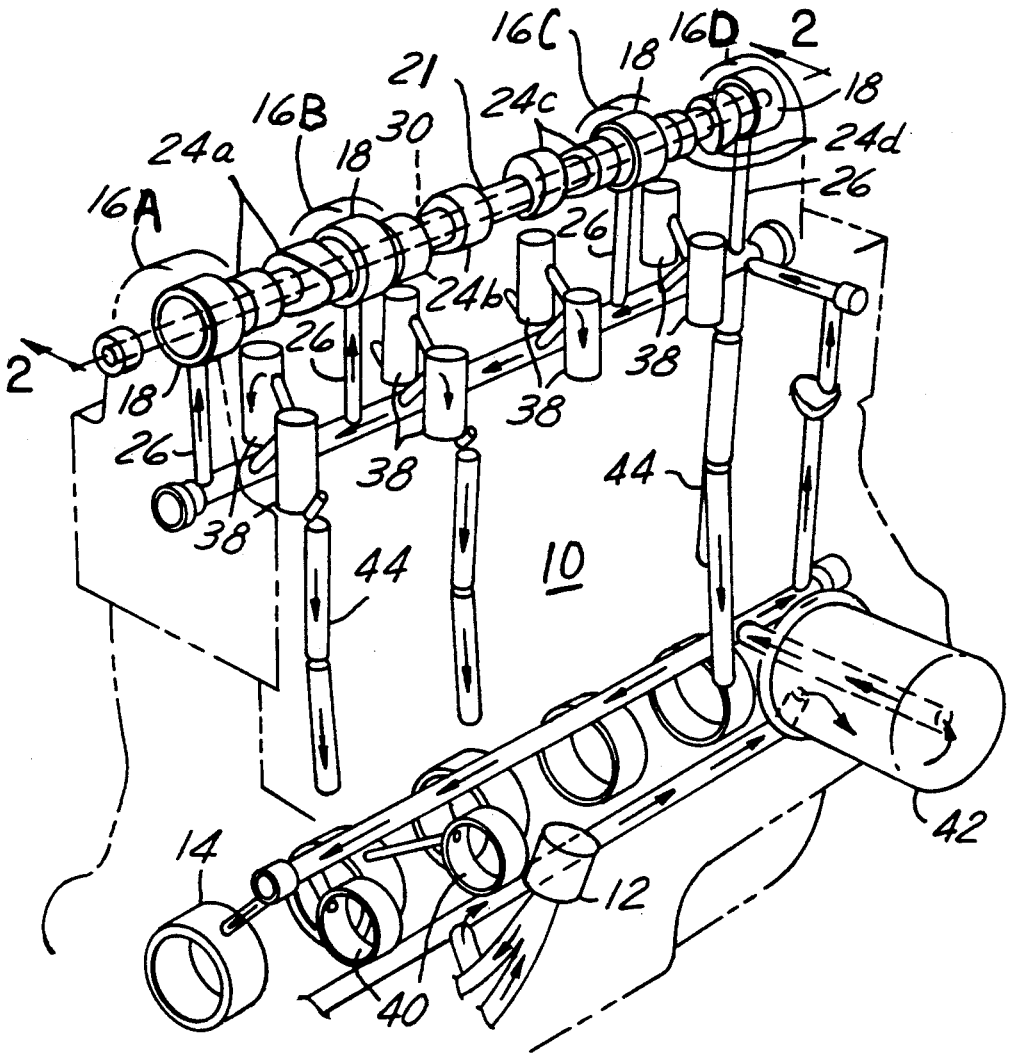
FIG. 1 illustrates an engine having an intermittent oiling system for its valve train according to the present invention.

As shown in FIG. 1, an engine, 10, is of the conventional overhead camshaft variety. The engine has an oil pump, 12, driven by the crankshaft (not shown) which supplies pressurized oil to various points at which lubrication is needed within the engine. Accordingly, main bearings, 14, upon which the crankshaft is journaled, are supplied with oil from oil pump 12. Similarly, the camshaft, 21, is provided with oil via camshaft support assemblies 16A–16D. As an alternative, camshaft 21 may be mounted within a series of bearings, 40, located in the block of the engine, with the valves being operated in conventional fashion by rocker arms and pushrods extending from lifters driven by the camshaft to rocker arms.

As shown in FIG. 1, oil moves from oil pump 12 through an oil filter, 42, and then through various passages to the points in the engine requiring oil lubrication. Oil reaching camshaft 21 ultimately returns to the crankcase of the engine via a series of drainback passages, 44. A system according to the present invention is beneficial because less oil is pumped up to camshaft 21, and, as a result, drainback passages 44 are not required to flow as much oil to the crankcase of the engine. This produces a positive result inasmuch as less oil is entrained into the air passing through the positive crankcase ventilation system of the engine, which in turn reduces the amount of oil being ingested into the intake of the engine. Further, oil pump 12 picks up oil which has less air entrained in it, and, as a result, lubrication of the engine is enhanced.

Figure 2:
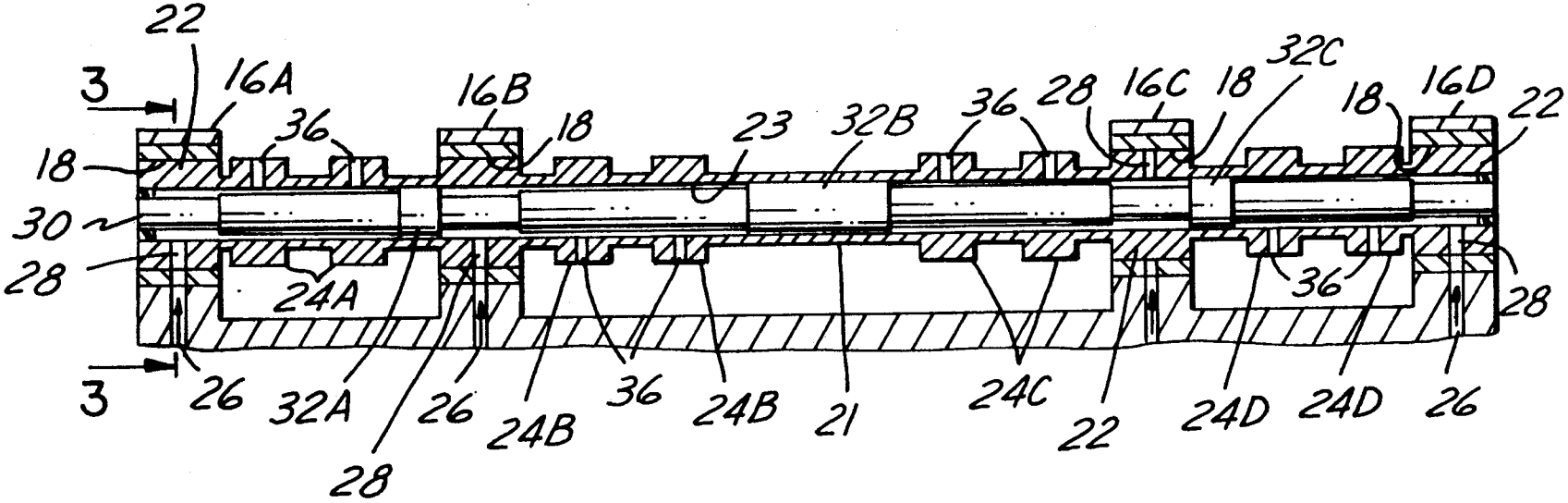
FIG. 2 illustrates a longitudinal cross-section of a portion of the cylinder head of the engine of FIG. 1 taken along the line 2—2 of FIG. 1.

Turning to FIG. 2, each support assembly 16A–D has a bearing surface, 18, which is in contact with and which supports one of the camshaft's journals, 22. Camshaft 21 has a plurality of cam lobes 24A–24D. The lobes actuate tappets and poppet valves (not shown). The tappets are housed within a plurality of bores, 38, formed in cylinder head 46.

Oil moving from oil Pump 12 and oil filter 42 passes upwardly through a series of camshaft supply passages 26 and arrives at the interfaces between camshaft journals 22 and cam bearing surfaces 18. The camshaft/cam bearing interface is shown with particularity in FIG. 3. Oil enters camshaft 21 through oil induction ports 28, which are drilled into each of journals 22. Note in FIG. 3 that each camshaft support assembly 16 has a groove, 20, formed therein. Each groove 20 extends for approximately 45° of rotation about bearing surface 18. As a result, each oil induction port 28 formed within a camshaft journal 22 will receive oil from a camshaft supply passage, 26, for about 45° of rotation of camshaft 21. Oil induction ports 28 are drilled at 90° intervals to each other about the axis of rotation of camshaft 21. As a result, only one of the four oil induction ports 28 will be in contact with its associated groove 20 for any particular rotational Position of camshaft 21. This means that only one of oil induction ports 28 will receive pressurized oil from oil pump 12 for any particular rotational position of camshaft 21. Because only one of the oil induction ports 28 will receive oil from the oil pump at any particular rotational position of camshaft 21, the oil consumed or required by the present intermittent oiling system will be less than that required by conventional systems which flooded the tappet gallery of the engine because oil was continuously supplied to the camshaft via the camshaft support assemblies. The timed oiling feature of the present invention thus results in the economical use of oil.

Figure 3:
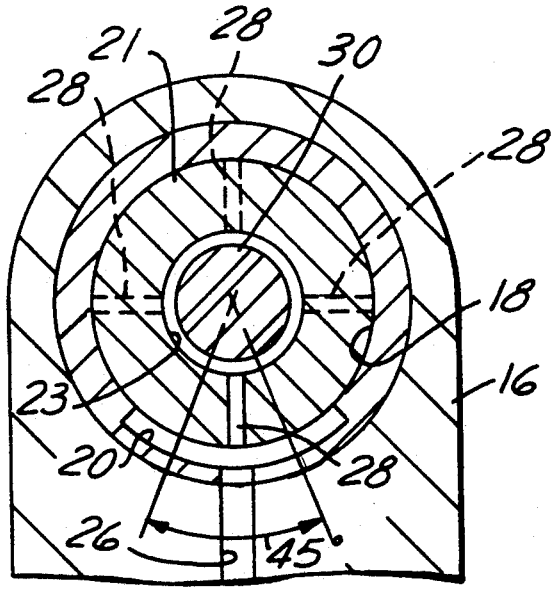
FIG. 3 is a cross-section of the camshaft and support assembly shown in FIG. 1, taken along the line 3—3 of FIG. 1.

FIG. 3 illustrates an end view of a plug, 30, which divides the interior of camshaft 21 into a plurality of separate internal lubrication passages, with each passage extending from one of the journals 22 to the surface of at least one of lobes 24.

Turning now to FIG. 2, it is readily seen that plug 30 subdivides the interior bore, 23, of camshaft 21 into a series of separated lubricant passages. For example, land 32A permits oil to pass from camshaft supply passage 26 formed in camshaft support assembly 16A through an annular space defined by plug 30 and bore 23 and out of lobes 24A through squirt ports 36 formed in lobes 24A. However, land 32A prevents oil from flowing past support assembly 16B to lobes 24B. Rather, any oil entering the annular space extending between support assembly 16A and support assembly 16B must flow out of the interior lubrication space via squirt ports 36 formed in cam lobes 24A. Squirt ports 36 are drilled through the cam lobes into contact with bore 23 in such a position that the oil erupts from the cam lobe a short period before the lobes contact their respective tappets.

Because the oil entering any one of the divided spaces defined by lands 32A, 32B, and 32C can leave the lubrication passages only by means of a pair of squirt holes 36, the volumetric flow of oil required to achieve a satisfactorily vigorous spray through squirt holes 36 is reduced. This fact produces another benefit because larger, more easily machined squirt holes may be used. Also, the pulsating oil flow resulting from the intermittent supply of oil to each section within camshaft 21, combined with the larger squirt holes, will help to obviate problems associated with plugging due to either contamination or sludge formation in the engine. The present invention has the result of downsizing the oil supply requirement of the camshaft and associated hardware. This may reduce the fuel consumption of the engine by reducing the load required to drive the engine's oil pump and may also reduce the strain of the oil pump drive system.

We claim:

1. An oiling system for an engine valve train, comprising:

a plurality of camshaft support assemblies, with each of said assemblies having a camshaft supply passage operatively connected with a source of lubricating oil under pressure; and a camshaft having a plurality of valve actuating lobes and a plurality of bearing journals, with said camshaft being journaled for rotation within said support assemblies such that one journal is mounted to each support assembly, with said camshaft having a plurality of separate internal lubrication passages, with each such passage extending from one of said journals to the surface of at least one of said lobes such that lubricating oil is conducted from said camshaft supply passages to said lobes.

2. An oiling system according to claim 1, wherein said source of lubricating oil comprises a lubricating oil pump driven by said engine.

3. An oiling system according to claim 1, wherein each of said internal lubrication passages is discontinuously provided with lubricating oil by means of a radially directed oil induction port formed in the camshaft journal associated with each internal lubrication passage.

4. An oiling system according to claim 3, wherein the bearing surface of each of said support assemblies is provided with an oil groove communicating with one of said oil induction ports, with said groove extending through approximately 45 degrees of rotation such that each of said internal lubrication passages is provided with lubricating oil from a camshaft supply passage for about 45 degrees of rotation of said camshaft.

5. An oiling system according to claim 1, wherein said separate internal lubrication passages are defined in part by a bore through said camshaft, with said bore being coaxial with said bearing journals, and by a plug inserted into said bore and having a plurality of lands formed thereon, such that lubricant may flow in a plurality of annular spaces defined by said bore and said plug.

6. An intermittent oiling system for an engine valve train, comprising:

a plurality of camshaft support assemblies, with each of said assemblies having a camshaft supply passage serviced with lubricating oil from an oil pump; and a camshaft having a plurality of actuating lobes and a plurality of bearing journals, with said camshaft being journaled for rotation within said support assemblies such that one journal is mounted to each support assembly, with said camshaft having a plurality of separate internal lubrication passages, with each such passage extending from one of said journals to the surface of at least one of said lobes such that lubricating oil is conducted from said camshaft supply passages to said lobes, with said internal lubrication passages each being fed by an oil induction port cooperating with a camshaft supply passage such that oil is admitted into only one of said internal lubrication passages at any particular rotational position of the camshaft.

7. An oiling system according to claim 6, wherein said lubricant induction ports are dispersed about the rotational axis of said camshaft.

8. An oiling system according to claim 6, wherein each of said lubricant induction ports is provided with lubricant for 90 degrees of camshaft rotation.

9. An oiling system according to claim 6, wherein said camshaft support assemblies are located in the cylinder block of an engine.

10. An oiling system according to claim 6, wherein said camshaft support assemblies are located in the cylinder head of an engine.

11. A method for providing lubrication to the valve train of an engine having a camshaft journaled within a plurality of camshaft bearing supports, comprising the steps of:

supplying oil under pressure to camshaft supply passages formed in the bearing supports;

allowing oil to pass discontinuously from the supply passages into a plurality of chambers formed in the interior of the camshaft by means of passages in the camshaft's journals and out of the chambers through exit ports formed in the lobes of the camshaft; and timing the flow of oil into the interior chambers such that not all of the chambers are simultaneously supplied with oil under pressure.

* * * * *